US009795184B2

(12) United States Patent
Ueda et al.

(10) Patent No.: US 9,795,184 B2
(45) Date of Patent: Oct. 24, 2017

(54) SHOE POSITIONING PLATE FOR BICYCLE SHOES

(75) Inventors: Yutaka Ueda, Osaka (JP); Junichi Kikuta, Osaka (JP); Toshiaki Aoki, Osaka (JP)

(73) Assignee: Shimano Inc., Osaka (JP)

( * ) Notice: Subject to any disclaimer, the term of this patent is extended or adjusted under 35 U.S.C. 154(b) by 1779 days.

(21) Appl. No.: 12/636,943

(22) Filed: Dec. 14, 2009

(65) Prior Publication Data

US 2011/0138658 A1 Jun. 16, 2011

(51) Int. Cl.

| | |
|---|---|
| ***A43B 5/00*** | (2006.01) |
| ***B62M 3/08*** | (2006.01) |
| ***A43B 5/14*** | (2006.01) |
| ***A43B 13/14*** | (2006.01) |

(52) U.S. Cl.
CPC ..... *A43B 5/14* (2013.01); *A43B 13/14* (2013.01); *Y10T 74/217* (2015.01)

(58) Field of Classification Search
CPC ..... A43B 5/14; A43B 13/14; Y10T 74/217
USPC ..... 36/131, 135; 74/594.6
See application file for complete search history.

(56) References Cited

U.S. PATENT DOCUMENTS

| | | | | |
|---|---|---|---|---|
| 5,007,185 | A | 4/1991 | Lazarski | |
| 5,211,076 | A | 5/1993 | Baume et al. | |
| 5,685,093 | A | 11/1997 | Lin | |
| 5,724,752 | A * | 3/1998 | Lin | 36/131 |
| D425,828 | S | 5/2000 | Ueda | |
| 6,119,551 | A | 9/2000 | Ueda | |
| 6,151,989 | A | 11/2000 | Ueda | |
| 6,725,742 | B2 | 4/2004 | Bremer | |
| 7,343,702 | B2 * | 3/2008 | Chao et al. | 36/135 |
| 7,503,133 | B2 | 3/2009 | Muraoka | |
| 7,533,480 | B2 * | 5/2009 | Chao et al. | 36/131 |
| 7,536,810 | B2 * | 5/2009 | Jau et al. | 36/131 |
| 2006/0016102 | A1 * | 1/2006 | Xie | 36/131 |
| 2006/0080865 | A1 * | 4/2006 | Chao et al. | 36/131 |
| 2007/0017127 | A1 | 1/2007 | Chao et al. | |
| 2007/0113428 | A1 * | 5/2007 | Jau et al. | 36/131 |
| 2008/0110294 | A1 | 5/2008 | Bryne | |

(Continued)

FOREIGN PATENT DOCUMENTS

| | | | |
|---|---|---|---|
| DE | 91 01 036.5 | U1 | 5/1991 |
| DE | 296 05 919 | U1 | 7/1996 |
| DE | 20 2004 011 494 | U1 | 1/2005 |

(Continued)

OTHER PUBLICATIONS

Shimano Inc.; 2009 Shimano Bike Gear; Shimano Shoes MTB; pp. 99-100;Model No. SH-MT30 Cleat Cap; Cad File.

(Continued)

*Primary Examiner* — Jila M Mohandesi
(74) *Attorney, Agent, or Firm* — Global IP Counselors, LLP

(57) ABSTRACT

A shoe positioning plate has a shoe facing side surface, a sole surface and a shoe positioning member. The sole surface is configured to be a part of a shoe sole when the shoe facing side surface is attached the shoe sole. The shoe positioning member includes at least one abutment disposed on an opposite side of the shoe positioning plate from the shoe facing side surface and extending in an elongated direction of a shoe when the shoe positioning plate is attached the shoe sole.

13 Claims, 9 Drawing Sheets

(56) References Cited

U.S. PATENT DOCUMENTS

2009/0320641 A1 12/2009 Delgorgue et al.

FOREIGN PATENT DOCUMENTS

| | | | |
|---|---|---|---|
| EP | 0 485 956 | A1 | 5/1992 |
| WO | WO-2008/029008 | A2 | 3/2008 |

OTHER PUBLICATIONS

German Search Report of corresponding German Application No. 20 2010 010 435.1 dated Feb. 14, 2011.

* cited by examiner

SHOE POSITIONING PLATE FOR BICYCLE SHOES

BACKGROUND

Field of the Invention

This invention generally relates to a shoe positioning plate for bicycle shoes. More specifically, the present invention relates to a shoe positioning plate that is designed to be installed on the sole of a bicycle shoe in place of a cleat.

Background Information

Bicycling is becoming an increasingly popular form of recreation as well as a means of transportation. Moreover, bicycling has become a very popular competitive sport. Whether the bicycle is used for recreation, transportation or competition, the bicycle industry is constantly improving their components.

Pedals are an essential bicycle component in that they transfer cycling power to the bicycle's drive train. Different styles of bicycles utilize different bicycle pedal styles that are designed for a specific purpose such as for pleasure, off road biking, road racing, etc. In recent years, step-in or clipless pedals have gained more popularity. The step-in or clipless pedal releasably engages a cleat secured to the sole of a rider's bicycle shoe. In other words, the cleats are attached to the sole of specially-designed bicycle shoes. The cleats lock the rider's feet into the pedals.

The step-in pedal has a pedal spindle that can be mounted on the crank of a bicycle, a pedal body that is rotatably supported on this pedal spindle, and a cleat engagement mechanism that clamps onto the cleat. In an off road bicycle pedal, both sides of the pedal body is provided with a cleat engagement mechanism for engaging a cleat. Road racing pedals typically only have a single cleat engagement mechanism on one side of the pedal body. In either case, in this type of bicycle pedal, the rider steps onto the pedal and the cleat engagement mechanism automatically grips on to the cleat secured to the bottom of the rider's bicycle shoe.

However, when the bicycle shoe is not engaged with the bicycle pedal, the cleat is normally exposed. Often, the cleat is disposed in a recess in the bottom surface of the sole of the bicycle shoe. To protect the cleat during walking or running, cleat caps have been developed for protecting the cleat. One example of such a cleat cap is disclosed in U.S. Pat. No. 5,007,185. Sometimes it may be desirable for the rider to remove the cleat from the bicycle shoe. In this case, a cover plate is installed in a recess of the sole of the bicycle shoe in place of the cleat. One example of such a cover plate is disclosed in U.S. Pat. No. 5,211,076. The cover plate disclosed in U.S. Pat. No. 5,211,076 is designed to mate with a non-step-in surface of the pedal.

In view of the above, it will be apparent to those skilled in the art from this disclosure that there exists a need for an improved bicycle pedal. This invention addresses this need in the art as well as other needs, which will become apparent to those skilled in the art from this disclosure.

SUMMARY

One object is to provide a shoe positioning plate, which can be used to mate with a step-in pedal without fixing the shoe positioning plate to the step-in pedal.

The foregoing object can basically be attained by providing a shoe positioning plate has a shoe facing side surface, a sole surface and a shoe positioning member. The sole surface is configured to be a part of a shoe sole when the shoe facing side surface is attached the shoe sole. The shoe positioning member includes at least one abutment disposed on an opposite side of the shoe positioning plate from the shoe facing side surface and extending in an elongated direction of a shoe when the shoe positioning plate is attached the shoe sole.

This object as well as other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF ILLUSTRATED EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
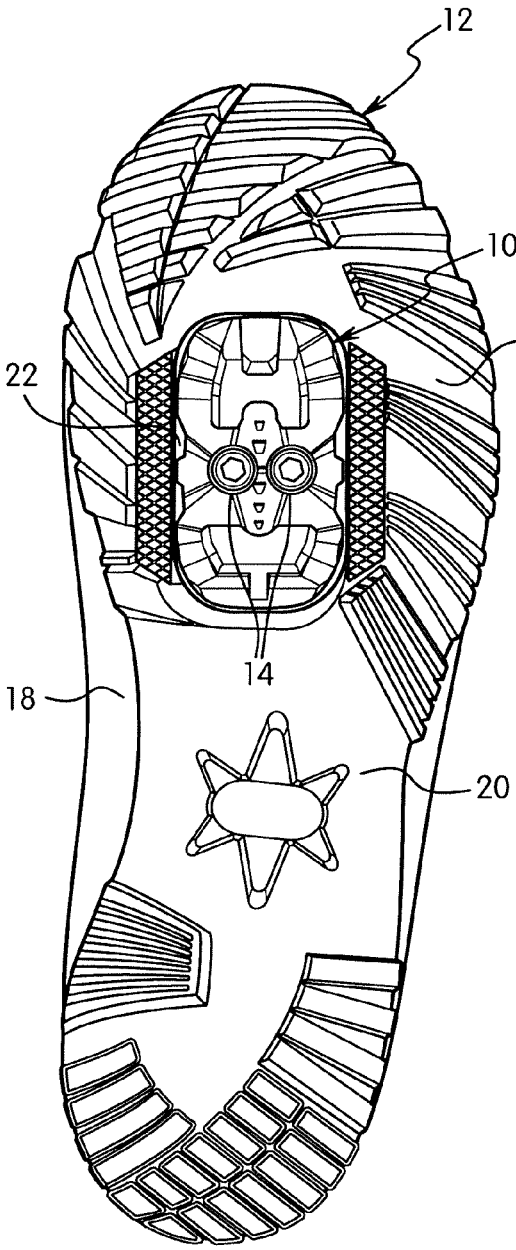
FIG. 1 is a bottom plan view of a left bicycle shoe with a shoe positioning plate attached thereto in accordance with one illustrated embodiment.
Figure 2:
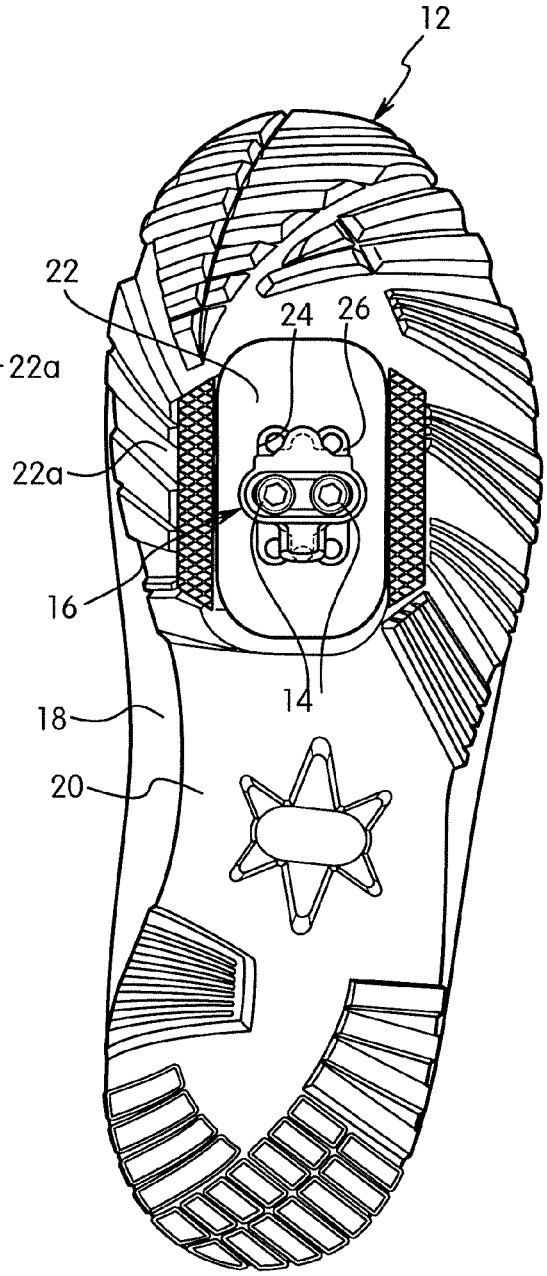
FIG. 2 is a bottom plan view of the left bicycle shoe illustrated in FIG. 1 with the shoe positioning plate removed and a conventional cleat attached thereto.

Referring initially to FIG. 1, a shoe positioning plate 10 is illustrated in accordance with one embodiment. The shoe positioning plate 10 is attached to a left bicycle shoe 12 by a pair of fasteners 14 (e.g., screws). As seen in FIG. 2, the shoe positioning plate 10 has been replaced with a cleat 16, which is attached to the bicycle shoe 12 by the fasteners 14. While a right bicycle shoe is not shown, it will be apparent to those skilled in the art from this disclosure that the shoe positioning plate 10 and the cleat 16 can be selectively mounted to the sole of the right bicycle in the same manner as described herein with respect to the left bicycle shoe 12.

In the illustrated embodiment, by way of example, the shoe positioning plate 10 and the cleat 16 are designed to be used with Shimano Pedaling Dynamics (SPD) line of clipless or step-in pedals. However, it will be apparent to those skilled in the art from this disclosure that the shoe positioning plate 10 can be adapted to be used in other types of clipless or step-in pedals. Thus, the shoe positioning plate of the present invention is not limited to Shimano Pedaling Dynamics (SPD) line of clipless or step-in pedals.

Figure 3:
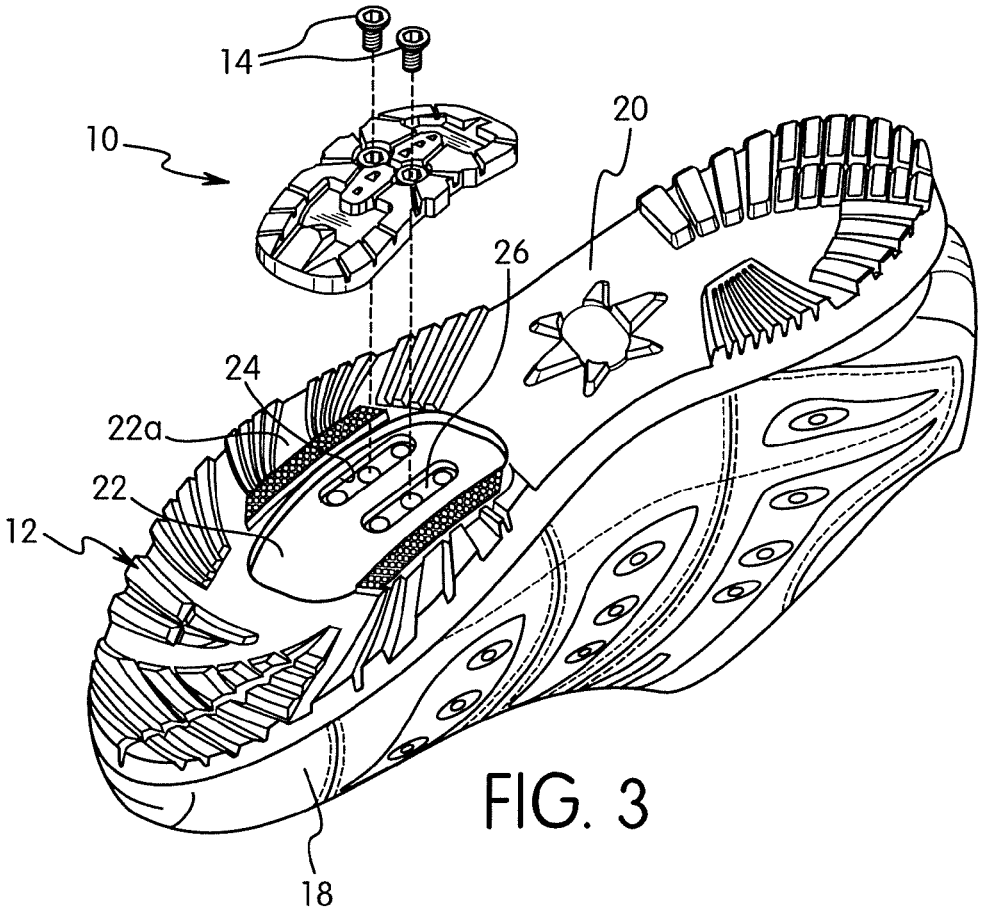
FIG. 3 is a perspective view of the bottom side of the left bicycle shoe illustrated in FIGS. 1 and 2 with the shoe positioning plate exploded out from the sole of the left bicycle shoe.
Figure 4:
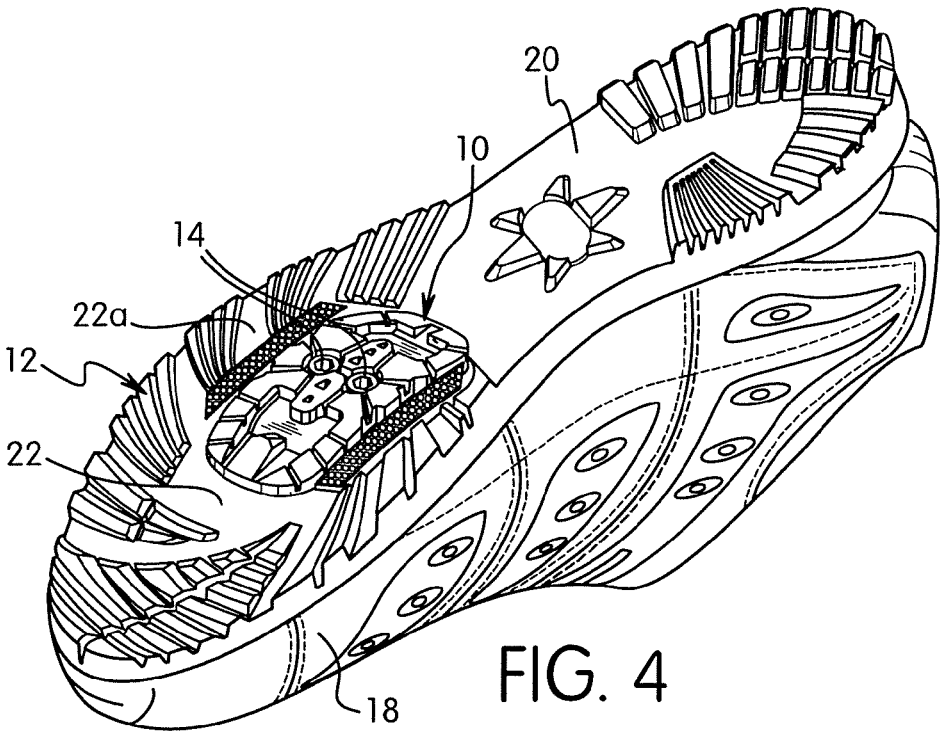
FIG. 4 is a perspective view of the bottom side of the left bicycle shoe illustrated in FIGS. 1 and 2 with the shoe positioning plate attached to the sole of the left bicycle shoe.

As seen in FIG. 3, the bicycle shoe 12 includes an upper part 18 and a shoe sole 20, with the shoe sole 20 having a recessed area 22 with two elongated attachment openings 24. A cleat nut plate 26 disposed inside the bicycle shoe 12 for receiving the fasteners 14 to attach either the shoe positioning plate 10 or the cleat 16 to the shoe sole 20. The cleat nut plate 26 has six threaded holes for receiving the fasteners 14 to selectively attach the cleat 16 in three different positions.

As seen in FIGS. 5 to 8, a clipless or step-in bicycle pedal 30 is illustrated for use with the shoe positioning plate 10 and the cleat 16. In the illustrated embodiment, by way of example, the bicycle pedal 30 is illustrated as a Shimano Pedaling Dynamics (SPD) clipless or step-in pedal. The bicycle pedal 30 is especially designed for use with off-road bicycles as opposed to use with a road bicycle. Of course, the bicycle pedal 30 can be a road type of bicycle pedal if needed and/or desired. Also the present invention can be applied to bicycle pedals other than Shimano Pedaling Dynamics (SPD) clipless or step-in pedals. Since step-in pedals such as the bicycle pedal 30 are well known, the bicycle pedal 30 will only be briefly described and/or illustrated herein.

When the shoe positioning plate 10 mates with the bicycle pedal 30, the shoe positioning plate 10 is not fixed to the bicycle pedal 30. This shoe positioning plate 10 is only inserted the bicycle pedal 30. The shoe positioning plate 10 can be especially useful to beginners who may be initially afraid to have their shoes fixed on bicycle pedals when they use the ordinary cleats. Therefore, someone, who has not used a step-in pedal system before, can easily step into a step-in bicycle pedal and experience the clip on pedal condition (relative position of a pedal and a shoe) without the shoe actually be fixed to the step-in bicycle pedal by using the shoe positioning plate 10. Since the shoe positioning plate 10 is not fixed to the step-in bicycle pedal, the shoe positioning plate 10 is easily removed from the bicycle pedal 30 with little resistance. Moreover, in bicycle shops or bicycle shows, when a customer tries to use a step-in bicycle pedal using the shoe positioning plates 10 on the shoes, the bicycle pedals is not injured.

Figure 5:
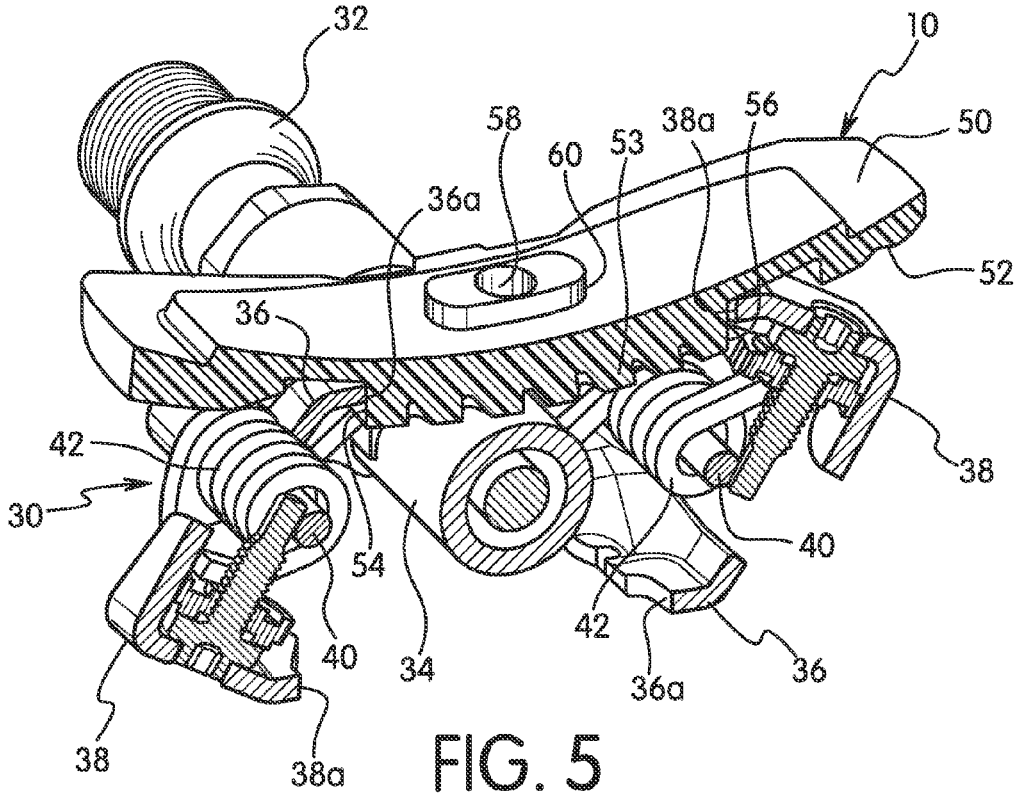
FIG. 5 is a perspective longitudinal cross sectional view of a left step-in bicycle pedal with the shoe positioning plate engaged or mated with a step-in bicycle pedal without fixing the shoe positioning plate to the step-in bicycle pedal.
Figure 6:
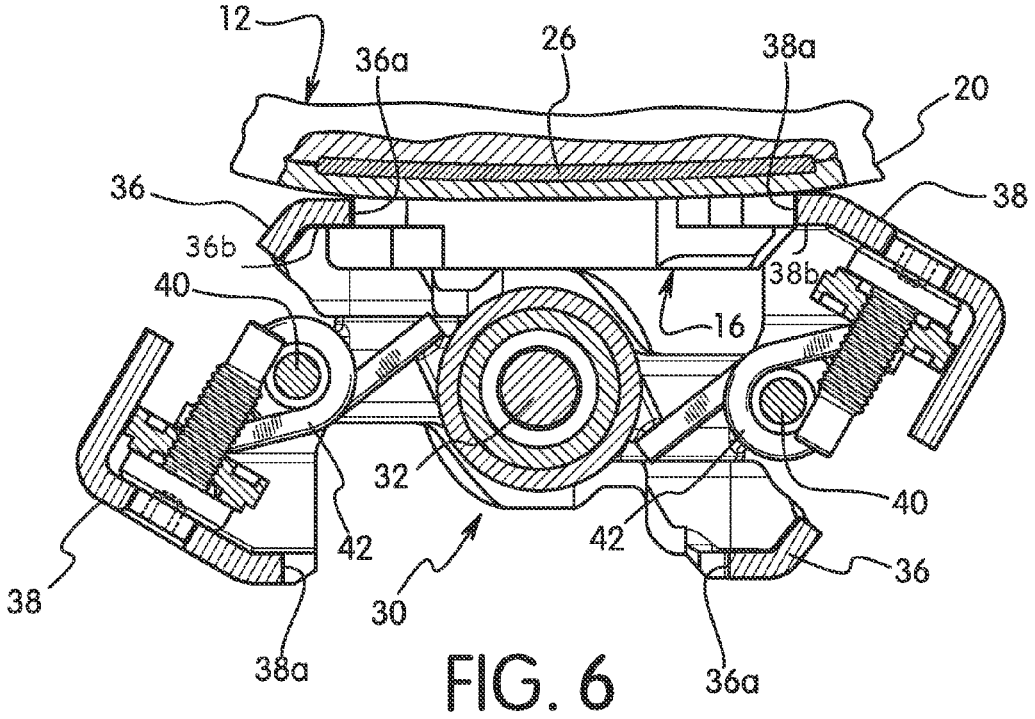
FIG. 6 is a longitudinal cross sectional view of the left step-in bicycle pedal with the cleat fixed to the step-in bicycle pedal.
Figure 7:
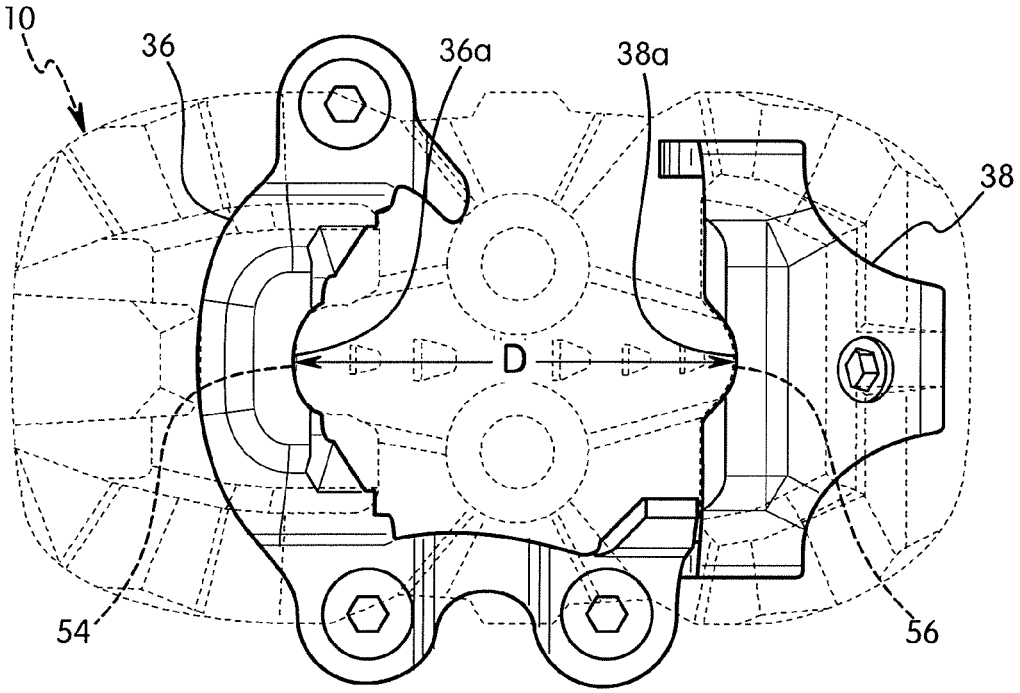
FIG. 7 is a top plan view of the front and rear cleat engagement members of the step-in bicycle pedal illustrated in FIGS. 5 and 6 with the shoe positioning plate shown in dashed lines to show the mating of the shoe positioning plate with the front and rear cleat engagement members.
Figure 8:
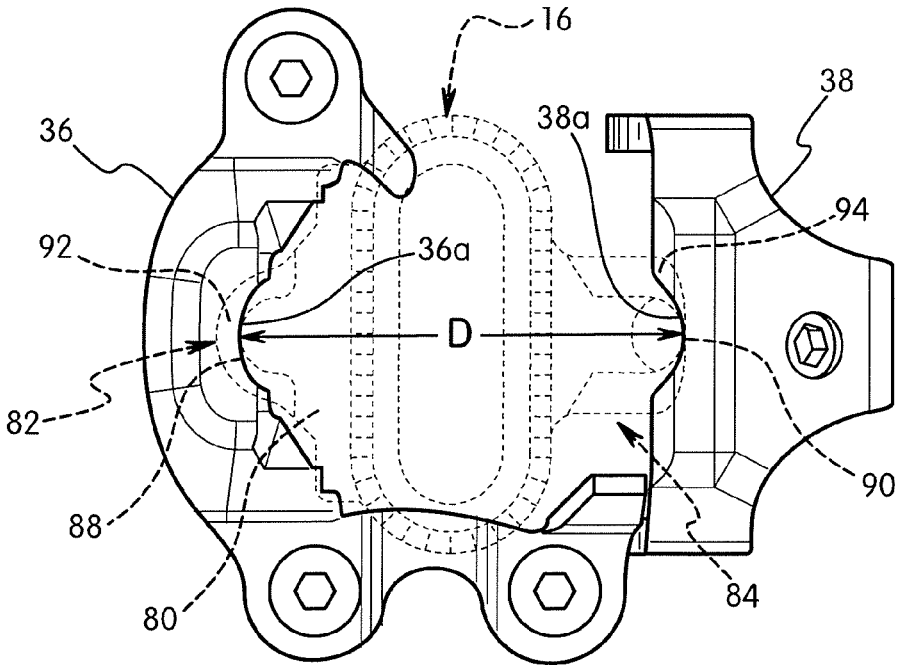
FIG. 8 is a top plan view of the front and rear cleat engagement members of the step-in bicycle pedal illustrated in FIGS. 5 and 6 with the cleat shown in dashed lines to show the mating of the cleat with the front and rear cleat engagement members.
Figure 9:
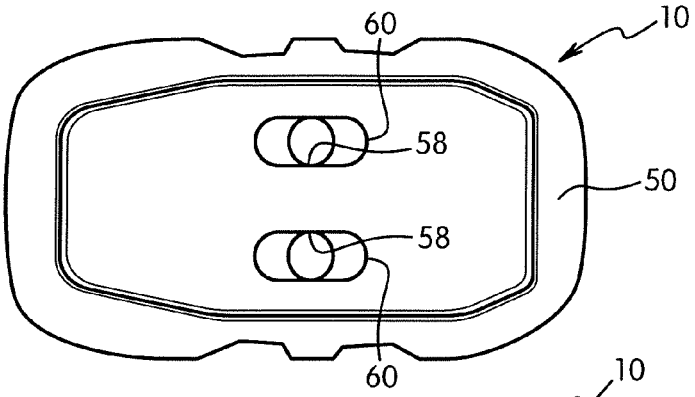
FIG. 9 is a top plan view of the shoe positioning plate, which cooperates with the step-in bicycle pedal illustrated in FIGS. 5 and 6.
Figure 10:
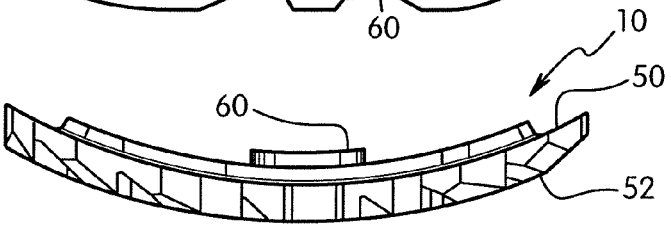
FIG. 10 is a side elevational view of the shoe positioning plate illustrated in FIG. 9.
Figure 11:
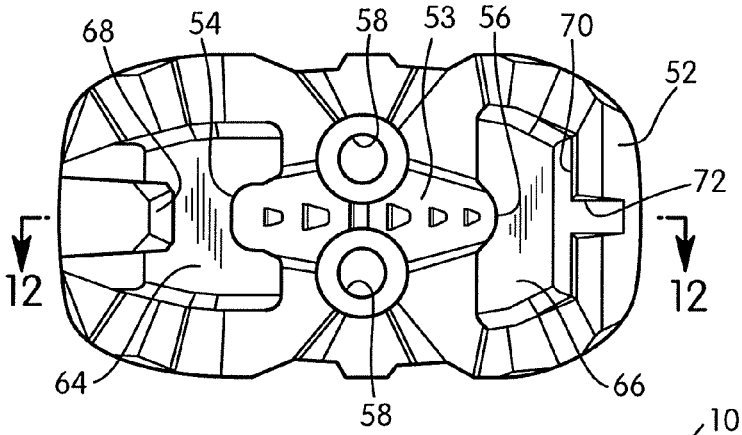
FIG. 11 is a bottom plan view of the shoe positioning plate illustrated in FIGS. 9 and 10.
Figure 12:
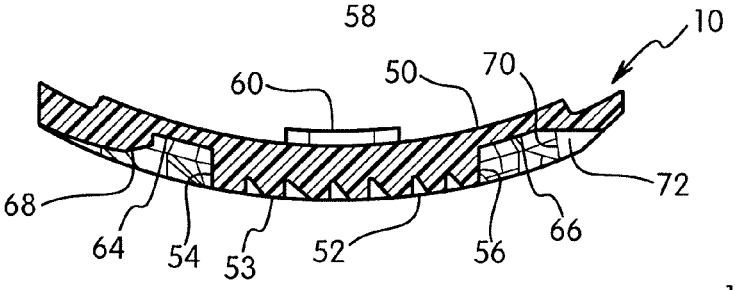
FIG. 12 is a cross-sectional view of the shoe positioning plate illustrated in FIGS. 9 to 11 as seen along section line 12-12 of FIG. 11.
Figure 13:
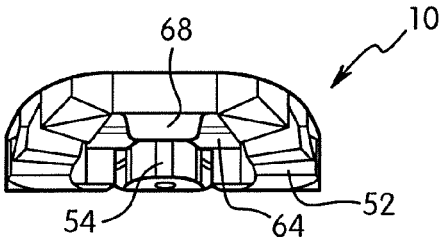
FIG. 13 is a front end elevational view of the shoe positioning plate illustrated in FIGS. 9 to 12.
Figure 14:
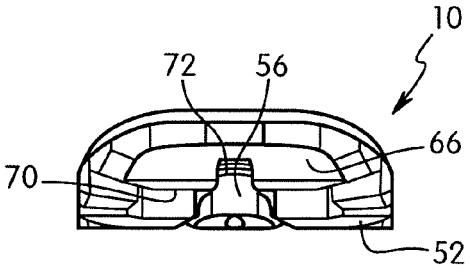
FIG. 14 is a rear end elevational view of the shoe positioning plate illustrated in FIGS. 9 to 13.
Figure 15:
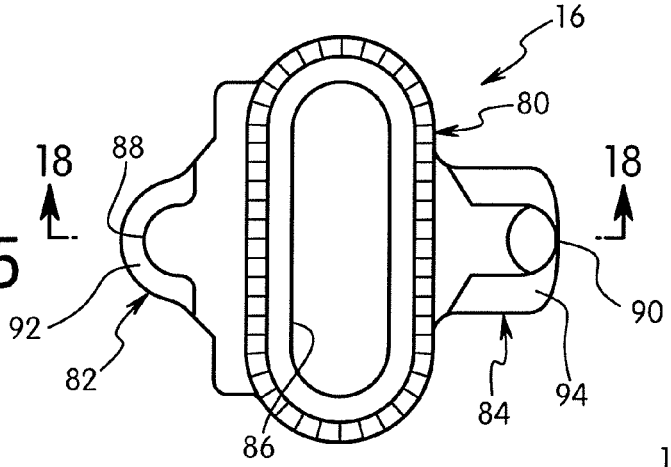
FIG. 15 is a top plan view of the cleat, which cooperates with the step-in bicycle pedal illustrated in illustrated in FIGS. 5 and 6.
Figure 16:
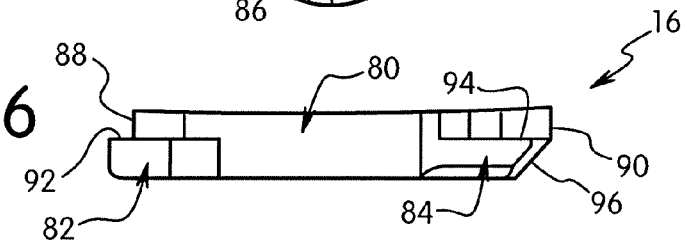
FIG. 16 is a bottom plan view of the cleat illustrated in FIG. 15.
Figure 17:
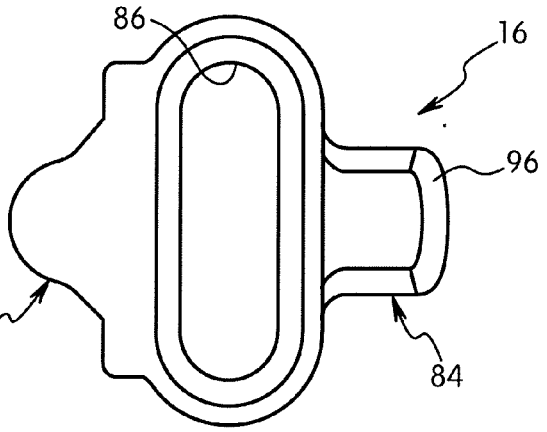
FIG. 17 is a side elevational view of the cleat illustrated in FIGS. 15 and 16.
Figure 18:
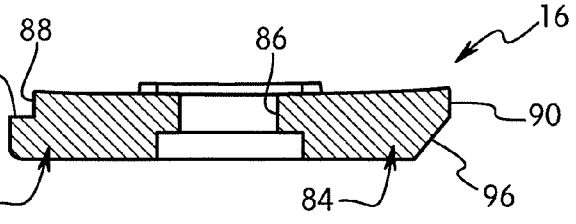
FIG. 18 is a cross-sectional view of the cleat illustrated in FIGS. 15 to 17 as seen along section line 18-18 of FIG. 15.
Figure 19:
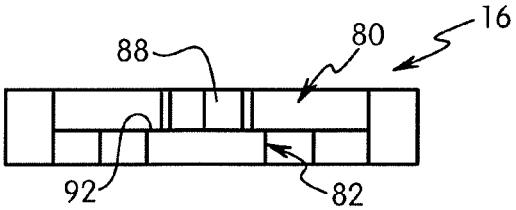
FIG. 19 is a front end elevational view of the cleat illustrated in FIGS. 15 to 18.
Figure 20:
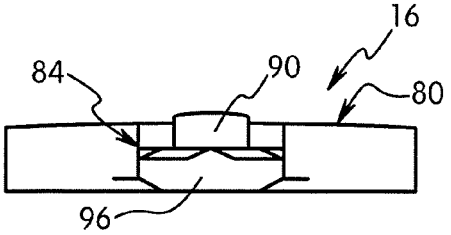
FIG. 20 is a rear end elevational view of the cleat illustrated in FIGS. 15 to 19.

As seen in FIGS. 5 and 6, the bicycle pedal 30 mainly includes a pedal spindle or axle 32, a pedal body 34, and a cleat engagement mechanism comprising a pair of front cleat engagement members 36 and a pair of rear cleat engagement members 38. The pedal spindle 32 is adapted to be threadedly coupled to a crank arm (not shown). The pedal body 34 is rotatably supported on the pedal spindle 32 for supporting a rider's foot. Each of the front cleat engagement members 36 is rigidly fixed to the pedal body 34 by a plurality (three) of attachment bolts (not shown), Each of the rear cleat engagement members 38 is pivotally coupled to the pedal body 34 by a pivot pin 40, with a biasing member 42 being mounted on each of the pivot pins 40 to bias the rear cleat engagement members 38, respectively, to a rest (cleat engagement) position.

As best seen in FIGS. 5 and 6, the front cleat engagement members 36 are each provided with a front stop surface **36*a* and a front pedal body facing surface 36*b*. The front stop surface 36*a* limits forward movement of the shoe positioning plate 10 (FIG. 5) or the cleat 16 (FIG. 6) with respect to the pedal body 34 depending on whether the shoe positioning plate 10 or the cleat 16 is attached to the shoe sole 20. The pedal body facing surface 36*b* faces toward the pedal body 34 and engages with the cleat 16 when the cleat 16 is engaged with the cleat engagement mechanism. The rear cleat engagement members 38 are each provided with a rear stop surface 38*a* and a rear pedal body facing surface 38*b*. The rear stop surface 38*a* limits rearward movement of the shoe positioning plate 10 (FIG. 5) or the cleat 16 (FIG. 6) with respect to the pedal body 34 depending on whether the shoe positioning plate 10 or the cleat 16 is attached to the shoe sole 20. The rear pedal body facing surface 38***b* faces toward the pedal body 34 and engages with the cleat 16 when the cleat 16 is engaged with the cleat engagement mechanism.

Turning now to FIGS. 9 to 14, the shoe positioning plate 10 has a shoe facing side surface 50, a sole surface 52 and a shoe positioning member 53. The shoe facing side surface 50 has an overall concave profile, and the sole surface 52 has an overall convex profile. The sole surface 52 is configured to be a part of the shoe sole 20 when the shoe facing side surface 50 is attached the shoe sole 20. The sole surface 52 is disposed on an opposite side of the shoe positioning plate 10 from the shoe facing side surface 52 and extends in an elongated (longitudinal) direction of the shoe 12 when the shoe positioning plate 10 is attached the shoe sole 20. In the illustrated embodiment, the shoe positioning plate 10 is a one-piece, unitary member, which is constructed from a suitable material such as a hard plastic material (e.g. synthetic resin) or any one of the materials are used in bicycle shoe soles. It is possible to make the shoe positioning plate 10 out of two or more separate parts, but typically this will increase production costs and/or decrease the ease of installation of the shoe positioning plate 10.

In this embodiment, the outer periphery of the shoe positioning plate 10 substantially matches the outer periphery of the recessed area 22 such that the shoe positioning plate 10 preferably fills at least a majority of the recessed area 22 and more preferably over eighty percent of the recessed area 22. The sole surface 52 is disposed so as to match the bottom surface of the shoe sole 20 when the shoe facing side surface 50 is attached the shoe sole 20. In other words, the sole surface 52 of the shoe positioning plate 10 contacts a flat surface when a ball area 20*a* (containing the recessed area 22) of the bicycle shoe 12 is positioned against the flat surface area. More preferably, the contour of the sole surface 52 matches the contour of the ball area 20*a* of the shoe sole 20 as view in a side elevational view of the bicycle shoe 12. In this way, the shoe positioning plate 10 and the surrounding bottom surface of the ball area 20*a* contact the ground together when the wearer is walking.

In this embodiment, the shoe positioning member 53 includes a forward abutment 54 and a rearward abutment 56, with the rearward abutment 56 facing in an opposite direction from the forward abutment 54. The tips (i.e., the farthest spaced apart points) of the forward and rearward abutments 54 and 56 are spaced apart by a prescribed cleat body distance D. In the illustrated embodiment, the forward and rearward abutments 54 and 56 are convex faces that cooperate with the front and rear stop surfaces 36*a* and 38*a*, respectively. In the illustrated embodiment, the forward and rearward abutments 54 and 56 mate with the front and rear stop surfaces 36*a* and 38*a*, respectively, such that the shoe positioning plate 10 can be inserted in between the front and rear stop surfaces 36*a* and 38*a* from a direction generally perpendicular to the bottom of the shoe sole 20 of the bicycle shoe 12 without causing the corresponding rear cleat engagement member 38 to be pivoted. In this way, the shoe positioning plate 10 can be removed from the bicycle pedal 30 without twisting the shoe positioning plate 10, which is needed to disengage the cleat 16 from the bicycle pedal 30 in practical terms. Of course, the prescribed cleat body distance D of the shoe positioning plate 10 can be preset with respect to the bicycle pedal 30 such that is moved slightly for a snug fit. Also, due to manufacturing tolerances and/or wear, the prescribed cleat body distance D of the shoe positioning plate 10 can be preset with respect to the bicycle pedal 30 such that a small amount of play (e.g., 2.0 millimeters) exists between the forward and rearward abutments 54 and 56 of the shoe positioning plate 10 and the front and rear stop surfaces 36*a* and 38*a* of the front and rear cleat engagement members 36 and 38, respectively. Thus, when the term "substantially" modifies the term "prescribed cleat body distance", the term "substantially" means±2.0 millimeters.

In the case of Shimano Pedaling Dynamics (SPD) clipless or step-in pedal systems, the prescribed cleat body distance D would be equal to 33.3 millimeters±2.0 millimeters. Of course, when the present invention is applied to other step-in pedal systems, the prescribed cleat body distance D would be different. Generically speaking, as used herein, the prescribed cleat body distance D of a shoe positioning plate constructed in accordance with the present invention refers to a distance corresponding to the length of a cleat body of a cleat for the clipless or step-in pedal system in which the shoe positioning plate is to be used. The cleat body refers to a fore-to-aft portion of the cleat with respect to the longitudinal direction of a bicycle pedal body, in which the fore-to-aft portion of the cleat is retrained from movement in the fore-to-aft portion with respect to the longitudinal direction of the bicycle pedal body. A cleat body (i.e., the fore-to-aft portion) of a cleat will be discussed below using an SPD cleat (e.g., the cleat 16) as an example to explain the meaning of the cleat body (i.e., the fore-to-aft portion) of the cleat.

The shoe positioning plate 10 is also provided with two fastener openings 58 in the shoe positioning member 53, with the fastener openings 58 extending between the shoe facing side surface 50 and the sole surface 52. In securing the shoe positioning plate 10 to the shoe sole 20, the fasteners 14 are inserted from the sole surface 52 of the shoe positioning plate 10 into the fastener openings 58 of the shoe positioning plate 10. The fasteners 14 pass through the fastener openings 58 of the shoe positioning plate 10 and then pass through the attachment openings 24 of the shoe sole 20, where they are then threaded into threaded holes in the cleat nut plate 26.

The shoe facing side surface 50 is further provided with two elongated protrusions 60. In this embodiment, the fastener openings 58 are located between the forward and rearward abutments 54 and 56 with respect to the longitudinal direction of the shoe positioning plate 10. The fastener openings 58 are arranged such that one of the fastener openings 58 passes through each of the elongated protrusions 60. The elongated protrusions 60 can have lengths that corresponds the lengths of the attachment openings 24 of the shoe sole 20 if needed and/or desired.

In this embodiment, the sole surface 52 has a forward recess 64 and a rearward recess 66. The forward recess 64 defines a forward face of the forward abutment 54. The rearward recess 66 defines a rearward face of the rearward abutment 56. A front guide 68 is partially defined by the forward recess 64. A rear face of the front guide 68 is inclined in a direction away from the shoe facing side surface 50 as the front guide 68 extends away from the forward abutment 54. A rear wall 70 is defined by the rearward recess 66. The rear wall 70 is disposed across the rearward recess from the rearward abutment 56 without any obstructions disposed in the rearward recess 66 between the rearward abutment 56 and the rear wall 70. In the illustrated embodiment, a gap exists between the rear wall 70 and the corresponding rear cleat engagement member 38. However, in certain step-in pedal systems, the rear wall 70 can contact a rear cleat engagement member to give a tighter mating contact between the shoe positioning plate 10 and the corresponding rear cleat engagement member.

In the shoe positioning plate 10 of the illustrated embodiment, a cutout 72 divides the rear wall 70 into two lateral parts. The rearward abutment 56 and the cutout 72 are disposed across the rearward recess 66 from each other such that the cutout 72 is aligned with the rearward abutment 56.

Referring now to FIGS. 13 to 18, the bicycle shoe cleat 16 is a conventional cleat that is used with Shimano Pedaling Dynamics (SPD) line of clipless or step-in pedals. The bicycle shoe cleat 16 includes a cleat body portion 80, a front retaining portion 82 and a rear retaining portion 84. The bicycle shoe cleat 16 has an attachment opening or slot 86 for receiving fasteners 14 to attach the bicycle shoe cleat 16 to the bicycle shoe 12 via the cleat nut plate 26 in a conventional manner. The bicycle shoe cleat 16 has an upper sole side facing in a first direction for engaging the shoe sole 20 of the shoe 12 and a lower pedal side facing in a second direction which is substantially opposite to the first direction. In the illustrated embodiment, the cleat body portion 80, the front retaining portion 82 and the rear retaining portion 84 are integrally formed together as a one-piece, unitary member, which is constructed from a suitable rigid material.

The cleat body portion 80 has a front curved stop surface 88 and a rear curved stop surface 90. The curved stop surface 88 is a convex surface that contacts the front stop surface 36*a* of the front cleat engagement member 36 to limits forward movement of the cleat 16 (FIG. 6) with respect to the pedal body 34. The curved stop surface 90 is a convex surface that contacts the rear stop surface 38*a* of the rear cleat engagement member 38 to limits rearward movement of the cleat 16 (FIG. 6) with respect to the pedal body 34.

The front retaining portion 82 has a nose portion with a first or front coupling surface 92. The coupling surface 92 faces towards the shoe sole 20 of the shoe 12, The front curved stop surface 88 is perpendicularly arranged with respect to the coupling surface 92. The coupling surface 92 engages the front pedal body facing surface 36*b* of the front cleat engagement member 36 to prevent the bicycle shoe cleat 16 from being pulled straight out of the bicycle pedal 30.

The rear retaining portion 84 has a nose portion with a second or rear coupling surface 94. The coupling surface 94 faces towards the shoe sole 20 of the shoe 12. The rear curved stop surface 90 is perpendicularly arranged with respect to the coupling surface 94. The coupling surface 94 engages the rear pedal body facing surface 38*b* of the rear cleat engagement member 38 to prevent the bicycle shoe cleat 16 from being pulled straight out of the bicycle pedal 30, The rear retaining portion 84 also has a ramp surface 96. The ramp surface 96 is designed to rotate the rear cleat engagement member 38 rearward from its normal cleat engaging position to its cleat releasing position as the cleat 16 is moved downward against the rear cleat engagement member 38.

In coupling the cleat 16 to the bicycle pedal 30, the rider steps onto pedal body 34 which in turn causes the rear cleat engagement member 38 to automatically grip onto the cleat 16 for securing to the shoe sole 20 of the bicycle shoe 12. More specifically, when attaching the bicycle shoe 12 to the step-in pedal 30 through the cleat 16, the rider moves the shoe 12 obliquely downwardly and forwardly relative to the pedal body 34 such that the front end of the cleat 16 engages the front cleat engagement member 36. Once the front end of cleat 16 is engaged with the front cleat engagement member 36, the rider places the rear end of cleat 16 in contact with the rear cleat engagement member 38. In this position, the rider presses the shoe 12 downwardly against the bicycle pedal 30 to cause the rear cleat engagement member 38 to initially pivot rearward against the force of the biasing member 42 to a cleat releasing position. Then, the rear cleat engagement member 38 returns under the force of the biasing member 42 so that the rear cleat engagement member 38 engages the rear end of the cleat 16. This engagement fixes the bicycle shoe 12 to the pedal 30 via the cleat 16. For all practical matters, the cleat 16 cannot be pulled straight out of the bicycle pedal 30 due to the large force of the biasing member 42. Rather to release the shoe 12 from the bicycle pedal 30, the rider will typically need to turn or twist the shoe 12 about an axis perpendicular or approximately perpendicular to the coupling surfaces 92 and 94 of the cleat 16. As a result of this pivoting or twisting action, the rear cleat engagement member 38 is pivoted against the force of the biasing member 42 to a cleat releasing position to release the shoe 12 from bicycle pedal 30.

Figure 21:
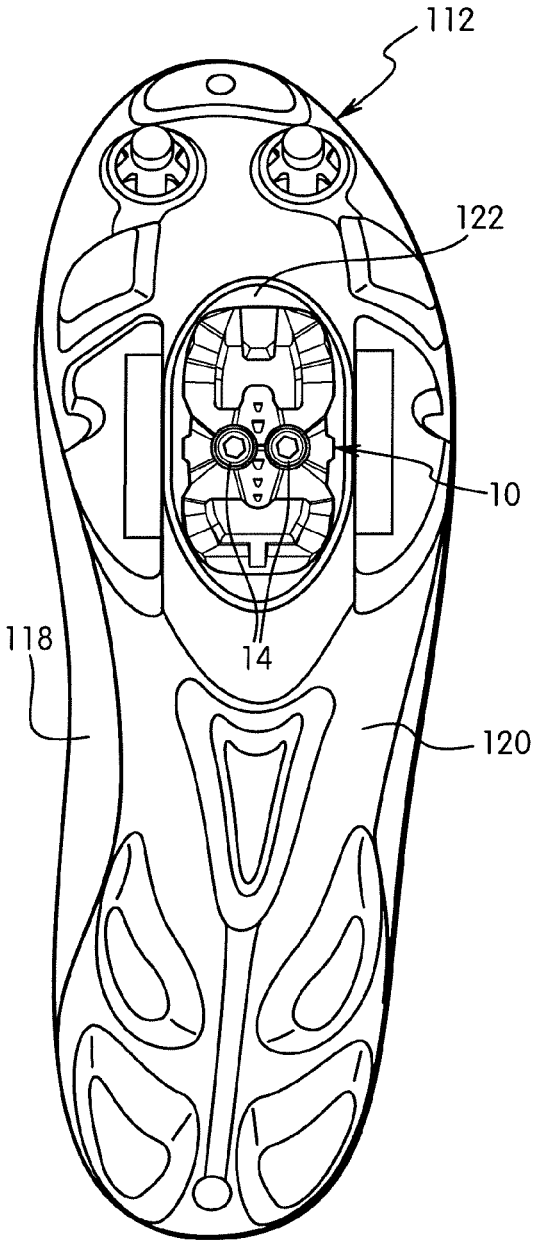
FIG. 21 is a bottom plan view of a left competition bicycle shoe with the shoe positioning plate illustrated in FIGS. 9 to 14.
Figure 22:
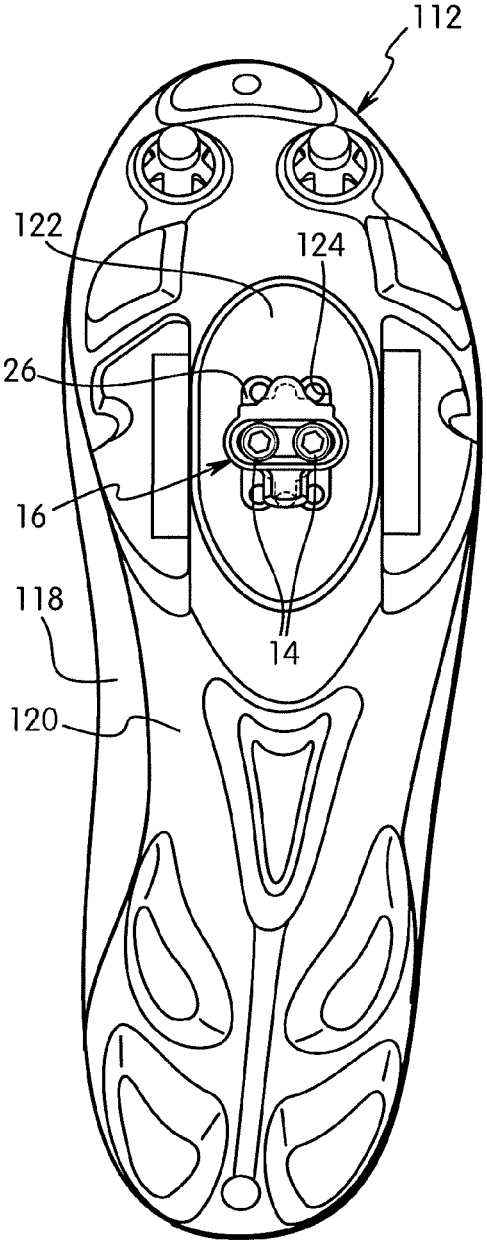
FIG. 22 is a bottom plan view of the left bicycle shoe illustrated in FIG. 21 with the shoe positioning plate removed and the conventional cleat of FIGS. 15 to 19 attached thereto.

As seen in FIGS. 21 and 22, the shoe positioning plate 10 (FIGS. 9 to 14) can be install on a competition bicycle shoe 112 if needed and/or desired. The bicycle shoe 112 includes an upper part 118 and a shoe sole 120, with the shoe sole 120 having a recessed area 122 with two elongated attachment openings 124. Of course, the shape of the shoe positioning plate 10 can be adjusted to the dimensions of the particular shoe. In other words, although the shoe positioning plate 10 is illustrated as being install directly on the competition bicycle shoe 112 without any modifications, it will be apparent to those skilled in the art that the dimensions of the shoe positioning plate 10 can be adjusted to better match the competition bicycle shoe 112 if needed and/or desired.

FIGS. 23 to 30 illustrate various shoe positioning plates 110, 210, 310 and 410 in accordance with other embodiment. These shoe positioning plates 110, 210, 310 and 410 can be used with the bicycle shoes 12 and 112 or any other bicycle shoe for step-in or clipless pedals as needed and/or desired. In each of the shoe positioning plates 110, 210, 310 and 410, a shoe positioning member is provided that mates with the bicycle pedal 30.

Figure 23:
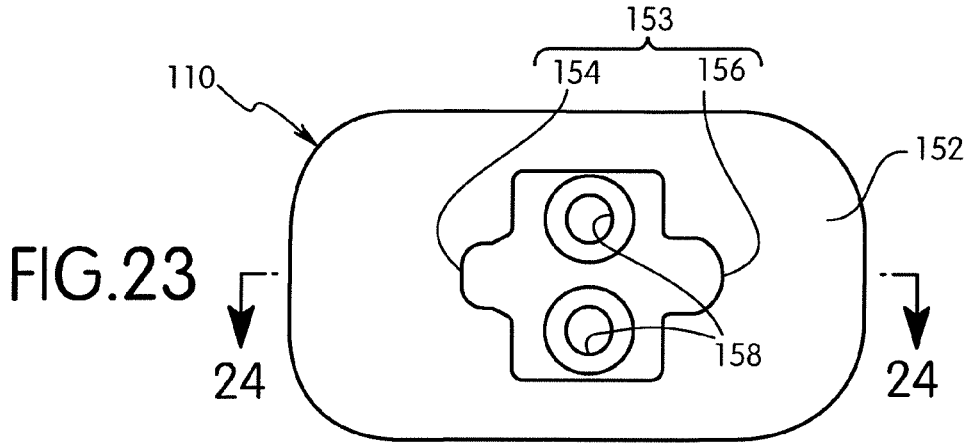
FIG. 23 is a bottom plan view of a shoe positioning plate in accordance with a second embodiment.
Figure 24:
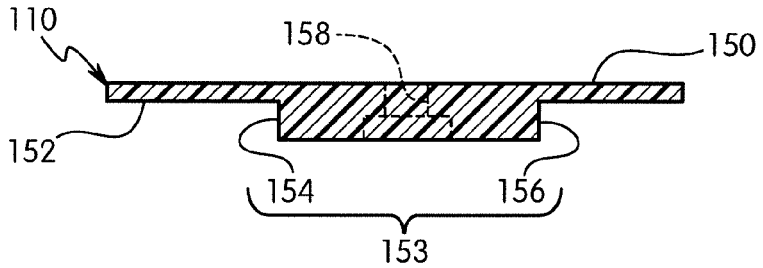
FIG. 24 is a cross-sectional view of the shoe positioning plate illustrated in FIG. 23 as seen along section line 24-24 of FIG. 23.

In particular, as seen in FIGS. 23 and 24, the shoe positioning plate 110 has a shoe facing side surface 150, a sole surface 152 and a shoe positioning member 153. In the illustrated embodiment, the shoe positioning plate 110 is a one-piece, unitary member, which is constructed from a suitable material such as a hard plastic material or any one of the materials are used in bicycle shoe soles. The shoe positioning member 153 includes a forward abutment 154 and a rearward abutment 156, with the rearward abutment 156 facing in an opposite direction from the forward abutment 154. The tips (i.e., the farthest spaced apart points) of the forward and rearward abutments 154 and 156 are spaced apart by the prescribed cleat body distance for the particular bicycle pedal. The shoe positioning plate 110 is also provided with two fastener openings 158 in the shoe positioning member 153, with the fastener openings 158 extending between the shoe facing side surface 150 and the sole surface 152.

Figure 25:
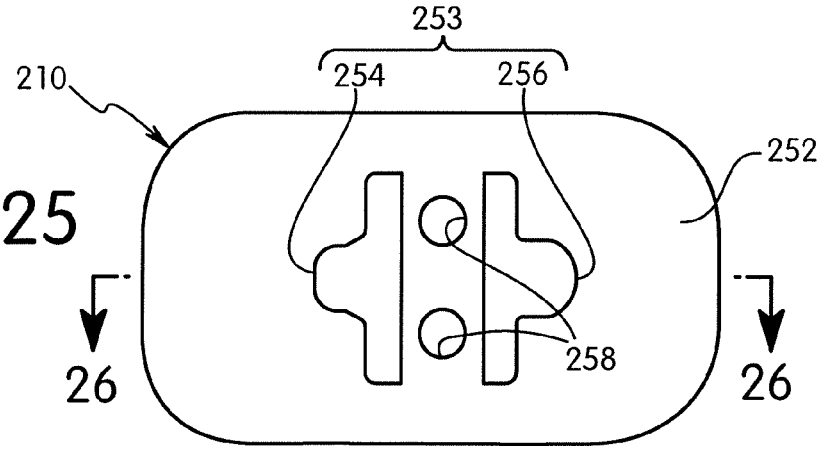
FIG. 25 is a bottom plan view of a shoe positioning plate in accordance with a third embodiment.
Figure 26:
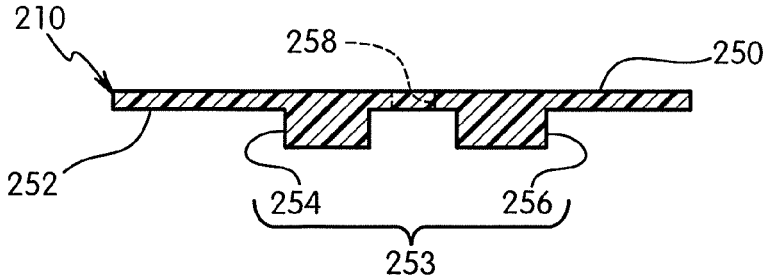
FIG. 26 is a cross-sectional view of the shoe positioning plate illustrated in FIG. 25 as seen along section line 26-26 of FIG. 25.

In particular, as seen in FIGS. 25 and 26, the shoe positioning plate 210 has a shoe facing side surface 250, a sole surface 252 and a shoe positioning member 253. In the illustrated embodiment, the shoe positioning plate 210 is a one-piece, unitary member, which is constructed from a suitable material such as a hard plastic material or any one of the materials are used in bicycle shoe soles. The shoe positioning member 253 includes a forward abutment 254 and a rearward abutment 256, with the rearward abutment 256 facing in an opposite direction from the forward abutment 254. In the illustrated embodiment, a recess divides the shoe positioning member 253 into two halves. The tips (i.e., the farthest spaced apart points) of the forward and rearward abutments 254 and 256 are spaced apart by the prescribed cleat body distance for the particular bicycle pedal. The shoe positioning plate 210 is also provided with two fastener openings 258 disposed between the two halves of the shoe positioning member 253, with the fastener openings 258 extending between the shoe facing side surface 250 and the sole surface 252.

Figure 27:
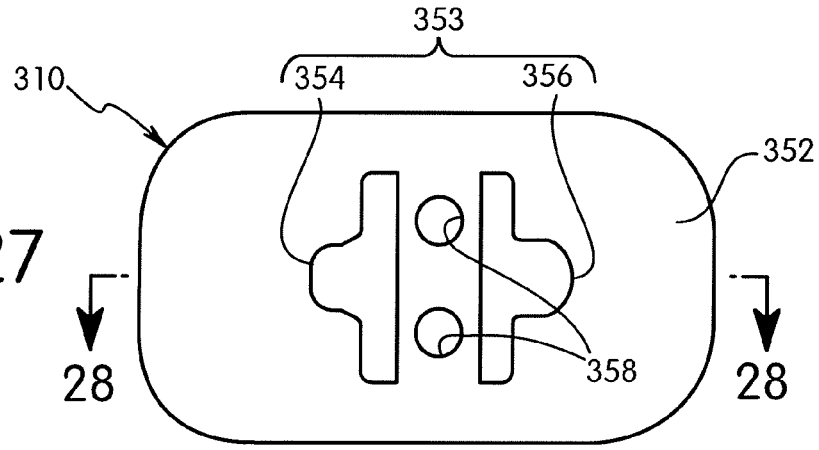
FIG. 27 is a bottom plan view of a shoe positioning plate in accordance with a fourth embodiment.
Figure 28:
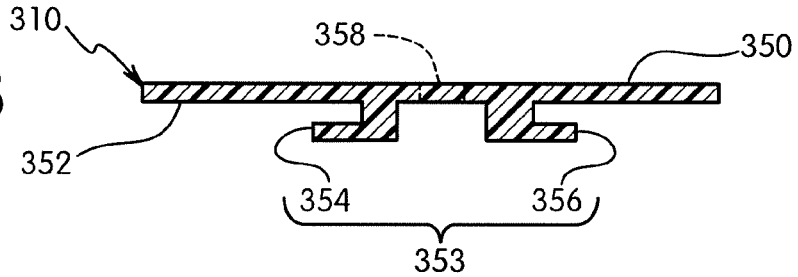
FIG. 28 is a cross-sectional view of the shoe positioning plate illustrated in FIG. 27 as seen along section line 28-28 of FIG. 27.

In particular, as seen in FIGS. 27 and 28, the shoe positioning plate 310 has a shoe facing side surface 350, a sole surface 352 and a shoe positioning member 353. In the illustrated embodiment, the shoe positioning plate 310 is a one-piece, unitary member, which is constructed from a suitable material such as a hard plastic material or any one of the materials are used in bicycle shoe soles. The shoe positioning member 353 includes a forward abutment 354 and a rearward abutment 356, with the rearward abutment 356 facing in an opposite direction from the forward abutment 354. In the illustrated embodiment, a recess divides the shoe positioning member 353 into two halves, with each half having a cantilevered part. The tips (i.e., the farthest spaced apart points) of the forward and rearward abutments 354 and 356 are spaced apart by the prescribed cleat body distance for the particular bicycle pedal. The shoe positioning plate 310 is also provided with two fastener openings 358 disposed between the two halves of the shoe positioning member 353, with the fastener openings 358 extending between the shoe facing side surface 350 and the sole surface 352.

Figure 29:
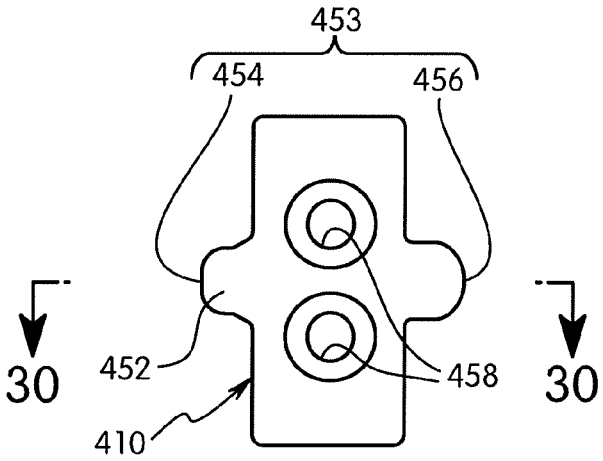
FIG. 29 is a bottom plan view of a shoe positioning plate in accordance with a fifth embodiment.
Figure 30:
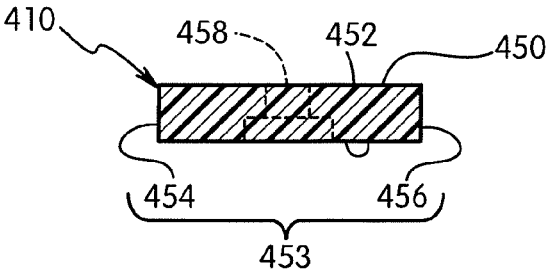
FIG. 30 is a cross-sectional view of the shoe positioning plate illustrated in FIG. 20 as seen along section line 30-30 of FIG. 29.

In particular, as seen in FIGS. 29 and 30, the shoe positioning plate 410 has a shoe facing side surface 450, a sole surface 452 and a shoe positioning member 453. In the illustrated embodiment, the shoe positioning plate 410 is a one-piece, unitary member, which is constructed from a suitable material such as a hard plastic material or any one of the materials are used in bicycle shoe soles. The shoe positioning member 453 includes a forward abutment 454 and a rearward abutment 456, with the rearward abutment 456 facing in an opposite direction from the forward abutment 454. The tips (i.e., the farthest spaced apart points) of the forward and rearward abutments 454 and 456 are spaced apart by the prescribed cleat body distance for the particular bicycle pedal. The shoe positioning plate 410 is also provided with two fastener openings 458 disposed between the two halves of the shoe positioning member 453, with the fastener openings 458 extending between the shoe facing side surface 450 and the sole surface 452. In the illustrated embodiment the outer periphery of the shoe positioning plate 410 is much smaller than the outer periphery of the recessed area 22 in the lengthwise direction. The overall width of the shoe positioning plate 410 is the same size as the shoe positioning plates 10, 110, 210 and 310, but smaller in the lengthwise direction. Thus, the shoe positioning plate 410 does not fill as much of the recessed area 22 as the shoe positioning plates 10, 110, 210 and 310, when the shoe positioning plate 410 is installed on the bicycle shoe 12 or 112.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiment(s), the following directional terms "forward", "rearward", "above", "downward", "vertical", "horizontal", "below" and "transverse" as well as any other similar directional terms refer to those directions of a bicycle equipped with the bicycle pedal. Accordingly, these terms, as utilized to describe the present invention should be interpreted relative to a bicycle equipped with the bicycle pedal as used in the normal riding position. Finally, terms of degree such as "substantially", "about", "generally" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A shoe positioning plate comprising:

a shoe facing side surface;

a sole surface configured to be a part of a shoe sole when the shoe facing side surface is attached to the shoe sole; and a shoe positioning member including at least one abutment disposed on the sole surface and extending in an elongated direction of a shoe when the shoe positioning plate is attached to the shoe sole, the shoe positioning member being configured and dimensioned to be inserted between a first cleat engagement member and a second cleat engagement member of a cleat engagement mechanism from a direction generally perpendicular to the shoe sole, and the at least one abutment being configured to abut one of the first cleat engagement member and the second cleat engagement member so as to limit forward movement of the shoe positioning plate, the cleat engagement mechanism being arranged on a pedal body of a pedal, the first cleat engagement member having a first stop surface that limits movement of the shoe positioning member or a shoe cleat in a first direction when the shoe positioning member or the shoe cleat is engaged with the cleat engagement mechanism, and a first pedal body facing surface that faces generally toward the pedal body, the second cleat engagement member having a second stop surface that limits movement of the shoe positioning member or the shoe cleat in a second direction when the shoe positioning member or the shoe cleat is engaged with the cleat engagement mechanism, and a second pedal body facing surface that faces generally toward the pedal body, the shoe positioning member being configured such that it does not engage with the first pedal body facing surface or the second pedal body facing surface when the shoe positioning member is inserted between the first cleat engagement member and the second cleat engagement member.

2. The shoe positioning plate according to claim 1, wherein the at least one abutment of the shoe positioning member includes a first abutment and a second abutment facing in an opposite direction from the first abutment, the first and second abutments being arranged to face the first stop surface of the first cleat engagement member and the second stop surface of the second cleat engagement member, respectively, when the shoe positioning member is inserted between the first and second cleat engagement members.

3. The shoe positioning plate according to claim 1, wherein the shoe positioning member has at least one fastener opening extending between the shoe facing side surface and the sole surface for attaching the shoe positioning member to the shoe sole.

4. The shoe positioning plate according to claim 2, wherein the first abutment is a forward abutment facing in a frontward direction of the shoe when the shoe positioning plate is attached to the shoe sole, and the second abutment is a rearward abutment facing in an opposite direction as the forward abutment, the forward and rearward abutments being spaced apart by a prescribed cleat body distance that corresponds to a prescribed cleat body portion of a shoe cleat that is configured to engage with the cleat engagement mechanism such that the cleat body portion is disposed between the front and rear cleat engagement members, the shoe cleat being configured to be attached to the shoe sole and including the cleat body portion having a front cleat body stop surface and a rear cleat body stop surface facing in opposite directions in the elongated direction of the shoe when the shoe cleat is attached to the shoe sole, a front retaining portion having a front coupling surface that faces toward the shoe sole when the shoe cleat is attached to the shoe sole, and a rear retaining portion having a rear coupling surface that faces toward the shoe sole when the shoe cleat is attached to the shoe sole, the front and rear cleat body stop surfaces being perpendicularly arranged with respect to the front and rear coupling surfaces and separated by the prescribed cleat body distance, the front and rear coupling surfaces being configured to engage with the first and second pedal body facing surfaces of the first and second cleat engagement members such that the shoe is fixed to the cleat engagement mechanism when the shoe cleat is engaged with the cleat engagement mechanism.

5. The shoe positioning plate according to claim 2, wherein the sole surface has a first recess that defines the first abutment, and a second recess that defines the second abutment.

6. The shoe positioning plate according to claim 1, wherein the abutment has a convex face.

7. The shoe positioning plate according to claim 1, wherein the sole surface has an overall convex profile.

8. A shoe assembly including the shoe positioning plate according to claim 3, further comprising a shoe including an upper part and a sole, with the sole having at least one attachment opening, at least one fastener securing the shoe positioning plate to the shoe sole, with the at least one fastener passing through the at least one fastener opening of the shoe positioning plate and passing through the at least one attachment opening of the sole.

9. The shoe positioning plate according to claim 2, wherein the first abutment and the second abutment have tip end portions spaced apart by a prescribed cleat body distance in the elongated direction of the shoe, the prescribed cleat body distance corresponding to a longest dimension of the shoe positioning member with respect to the elongated direction of the shoe.

10. The shoe positioning plate according to claim 9, wherein the prescribed cleat body distance is substantially 33.3 millimeters.

11. The shoe positioning plate according to claim 4, wherein the prescribed cleat body distance is substantially 33.3 millimeters.

12. The shoe positioning plate according to claim 4, wherein the forward abutment is a most forward portion of the shoe positioning member with respect to the elongated direction of the shoe while the shoe positioning plate is attached to the shoe sole, and the rearward abutment is a most rearward portion of the shoe positioning member with respect to the elongated direction of the shoe when the shoe positioning is attached to the shoe sole.

13. The shoe positioning plate according to claim 2, wherein the first abutment is configured to mate with the first stop surface and the second abutment is configured to mate with the second stop surface.

* * * * *